United States Patent [19]

Dow et al.

[11] 3,950,475

[45] Apr. 13, 1976

[54] METHOD OF PRODUCING BANDED FIBERS FROM A THERMOPLASTIC SHEET

[75] Inventors: James Dow, Thaxted; Ronald Lloyd, Sawbridgeworth; Albert George Patchell, Welwyn Garden City, all of England

[73] Assignee: Smith & Nephew Polyfabrik Limited, England

[22] Filed: Jan. 17, 1973

[21] Appl. No.: 324,475

Related U.S. Application Data

[63] Continuation of Ser. No. 7,828, Feb. 2, 1970, abandoned.

[30] Foreign Application Priority Data

Feb. 5, 1969 United Kingdom ..... 6132/69

[52] U.S. Cl. ..... 264/154; 264/DIG. 47

[51] Int. Cl.[2] ..... B29C 17/02; B29D 27/00

[58] Field of Search ..... 264/DIG. 47, 288, 289, 264/291, 154; 28/DIG. 1

[56] References Cited

UNITED STATES PATENTS

| | | | |
|---|---|---|---|
| 3,441,638 | 4/1969 | Patchell et al. | 264/289 |
| 3,485,705 | 12/1969 | Harmon | 264/146 |
| 3,488,415 | 1/1970 | Patchell et al. | 264/289 |
| 3,494,522 | 2/1970 | Kim et al. | 264/DIG. 47 |
| 3,511,742 | 5/1970 | Rasmussen | 264/DIG. 47 |
| 3,541,197 | 11/1970 | Hughes | 264/DIG. 47 |
| 3,632,716 | 1/1972 | Fairbanks | 264/DIG. 47 |
| 3,851,034 | 11/1974 | Harmon | 264/147 |

FOREIGN PATENTS OR APPLICATIONS

| | | | |
|---|---|---|---|
| 6,711,840 | 10/1968 | Netherlands | 264/DIG. 47 |
| 1,176,357 | 1/1970 | United Kingdom | 264/DIG. 47 |

*Primary Examiner*—Robert F. White
*Assistant Examiner*—James B. Lowe
*Attorney, Agent, or Firm*—Dike, Bronstein, Roberts, Cushman & Pfund

[57] ABSTRACT

Interconnected fibres banded by cross-sectional orientation and morphology differences, in an array which can be bundled up to separate the fibres at least partially. A thermoplastic sheet emboding areas of different degrees of fibrillation is cold drawn to initiate longitudinally extending cracks in the areas of lower resistance to fibrillation such that the cracks terminate at the areas of higher resistance to fibrillation. The sheet is then further drawn at a higher temperature to open the cracks and to cause the cracks to propagate through the areas of higher resistance to fibrillation. Both drawing steps are performed without lateral extension.

11 Claims, 12 Drawing Figures

INVENTOR
JAMES DOW ET AL
by Roberts, Cushman & Grover
ATTORNEYS

INVENTOR
JAMES DOW ET AL
by Roberts, Cushman & Grover
ATTORNEYS

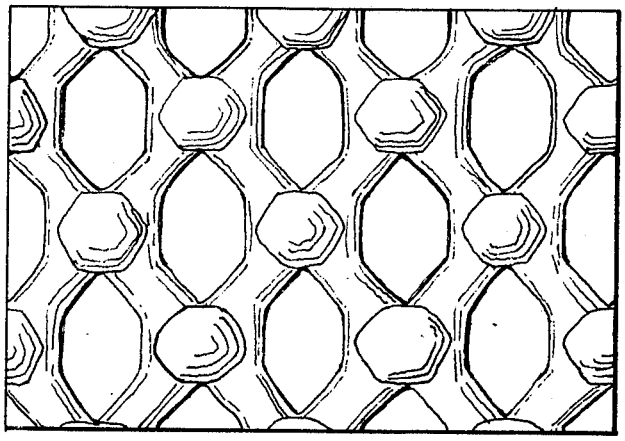
FIG.5a.
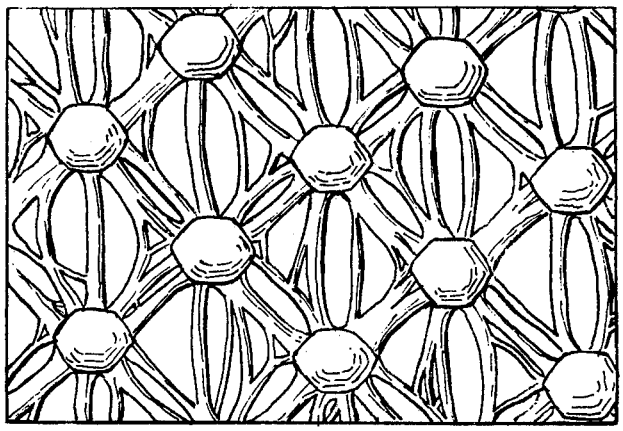
FIG.5b.
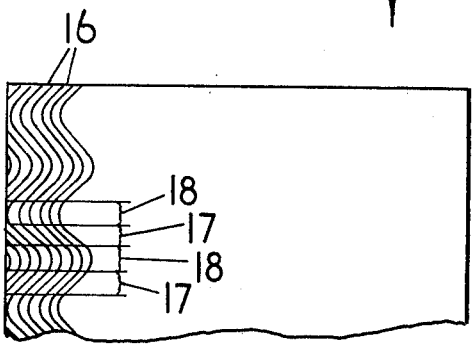
FIG.6.
FIG.7.
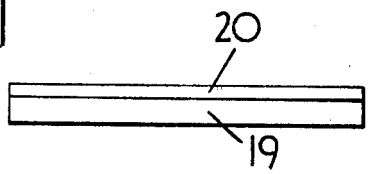
INVENTOR
JAMES DOW ET AL
by Roberts, Cushman + Grover
ATTORNEYS

METHOD OF PRODUCING BANDED FIBERS FROM A THERMOPLASTIC SHEET

This is a continuation of application Ser. No. 7828, filed on Feb. 2, 1970, now abandoned.

This invention relates to synthetic fibres.

More specifically, the invention relates to banded fibres, as hereinbelow defined, having an alteration of different properties along the fibre and arranged in an at least partially interconnected fashion as a longitudinal array of fibres. The term "alternation" is intended in its broad sense, to cover two or more types of differences along the fibre, either regularly or randomly distributed, but for convenience will mostly be described with reference to two component alternations. That is to say, while the invention is predominantly described with reference to an . . . ABABABA . . . type of fibre structure it includes . . . ABCABCABCA . . . regular structures and, e.g. . . . ABACBACBCABA . . . random structures together with higher orders of components and randomness.

Such fibres, although of general utility can be woven into coarse compact backing or used in ropes or twines of good knot strength. The banding along the length gives different properties in the different bands, such as different dyeabilities. Also, such fibre can give yarns and fibres which are bulky but still flexible by virtue of e.g. the presence of thinner bands.

To define at the outset the terms used, "fibre" means any longitudinally extending single piece of synthetic plastic material whose transverse measurement is very small compared to its length (e.g. at least 1:100 and usually 1:700 – 1:5000 or more) and the size of which is so related to its physical properties as to permit bending, twisting, knotting, coiling, crimping and like manipulative treatments. A filament is a fibre of indefinite length. A "yarn" is a twisted bundle of fibres. "Staple fibre" is fibre chopped into, or otherwise occurring in, short lengths.

A longitudinal array of fibres can either occur in the form of a bundle of fibres or in the form of a stretched tape-like structure.

While the invention is concerned with all the materials described in the preceding paragraph (and with non-woven woven and knitted fabrics, and ropes or twine made from or incorporating such materials) its has primary relevance to longitudinal arrays of fibres produced by stretching and fibrillating a sheet of material usually split into convenient tapes, and to yarns produced from such longitudinal fibrous arrays.

In its broad form the invention can utilise any fibre-forming synthetic polymeric material. In practice, the inventors envisage the cold-drawable materials, specific examples of which are polypropylene, high-density polyethylene(HD), polyesters or polyamide. Blends of these materials are particularly valuable, either the homogeneous blends (such as most low-density polyethylene/HD blends) or the heterogeneous blends such as most polypropylene/polyamide blends. This is described more fully below.

The invention accordingly consists in a longitudinal array of interconnected fibres the individual longitudinal fibres of which are continuously banded along their length by possessing successive regions of different cross-sectional area, degree of orientation and morphology. The bands may constitute either two-stage alternation or higher orders of alternation, regular or random.

The invention further consists in a fibre bundle produced by bundling up such an array, whether or not this completely separates the individual fibres.

The fibres within such an array can be considered in two main groups. In one, the fibres themselves consist of thick portions and thin portions in two-component or multi-component alternation, the size of the alternate bands being sometimes somewhat irregular. In the other, the fibres are of higher-order denier and have in two-component or multi-component alternation a solid portion and a multistrand portion. The term "multistrand" is intended to include two or more strands. The strands of the multistrand portions, it will be appreciated, are themselves integral at each of their ends with the neighbouring solid portions.

Any transverse section of the fibre array will not necessarily include all narrow portions or all broad portions; in other words like bands are not necessarily side by side in adjacent fibres of an array. The preferred method of manufacture of such materials, described in more detail below, ensured this favourable configuration.

It should also be borne in mind that, inasmuch as the fibres according to the invention are produced by fibrillation of a highly stretched sheet or film usually having a pattern of raised and/or depressed portions, they will often include various subsidiary fibrils and the like. This is no disadvantage (and is indeed a feature of the invention in some specialised embodiments) but it should at all times be borne in mind that the individual fibres of the array of fibers have a structure which, under examination by microscope or other testing, is basically banded irrespective of such additional characteristics.

The preferred process for making the array of fibres according to the invention comprises two essential steps:

a. taking a sheet or tape of cold-drawable film of synthetic plastic material having on one or both sides or within its thickness a regular or irregular pattern or arrangement of regions of different morphology such that longitudinal sections along the sheet or tape show regular or irregular differences respectively in such morphology.

b. stretching the sheet or tape to produce a longitudinal array having identifiable interconnected but essentially longitudinal fibres banded along their length by possessing successive regions of different cross-sectional area, degree of orientation and morphology.

Usually the invention involves the additional step of forming a stretched sheet or tape constituting the array into a bundle of fibres.

Forming a stretched tape-like structure, comprising more or less interconnected longitudinal fibres, into a bundle of less inter-connected fibres can be effected by mechanical means (brushing, or dragging the structure over threaded rollers), by fluid agitation (e.g. by passing through an air venturi or by ultrasonic waves.

Such a bundle can be formed by passing a stretched tape-like array through a zone where the interconnections may become reduced in number, or totally eliminated, and bundling up the fibres into a "tow-like" structure.

Degree of orientation can be measured by means of standard laboratory techniques such as X-ray diffraction or birefringence measurements. These methods are described in "Encyclopedia of Science and Technology" Vol. 9 pp 630 – 636.

By differences in morphology is meant structural differences on the surface and/or within the thickness of the film, especially those relating to size, shape and arrangement of the polymer crystallites. For example, and as will be made clearer below, a rapidly cooled film will possess smaller crystallites than a slowly cooled film. That is to say, "morphology is used in the sense of polymer bulk morphology," and differences in morphology can readily be detected by optical techniques including microscopic examination of thin sections using polarised light.

The differences in morphology within the film can be caused by differential cooling of an extruded melt forming the film (either as mere cooling or as a consequence of impressing a pattern with a chilled roller) or by differential irradiation in a regular or irregular pattern. Also, a pattern of perforations can lead to differences in film morphology especially if flame perforation has been used.

Usually, differences in morphology correspond to differences in film thickness. An especially preferred type of film has on at least one surface a regular pattern of discrete raised embossments. It is especially valuable if the embossments are arranged in a staggered relationship such as that afforded by rhomboidal or hexagonal packing.

Such embossed films can in one form of the invention be stretched longitudinally without lateral restraint to initiate a longitudinal crack between each laterally adjacent pair of embossments and to propagate the crack through elongated and oriented embossments in preceding and subsequent rows thereof so as to form a longitudinal array of interconnected banded fibres the bands on which correspond to the strands connecting the embossments and to the split elongated embossments themselves respectively.

In an alternative form of the invention the film may be (a) stretched longitudinally with lateral restraint or with simultaneous lateral stretching, to initiate pairs of cracks one crack of each pair on each side of each embossment, and to fibrillate the strands formed between each embossment and (b) stretched longitudinally so that the embossments stretch and orientate and the cracks propagate and split the elongated and orientated embossments so as to form a bundle of interconnected banded fibres the bands on which correspond to the fibrillated strands connecting the embossments, and to the split elongated embossments themselves respectively.

It is in any case particularly valuable if the stretching step of the invention is also effected in two stages, the first at a lower temperature to impart the initial fibrillation and the second at a higher temperature to facilitate drawing and splitting of the bosses or corresponding thicker bands in the fibres.

Of course, in place of raised embossments, the film can possess a pattern of discrete depressions or of two intersecting sets of parallel straight grooves or have on one surface a set of parallel grooves and on the other surface another set of parallel grooves, the two sets lying in intersecting directions. All such films can be stretched either longitudinally only or longitudinal after initial biaxial stretch to produce bundles of different types of banded fibres, as described more fully below.

The types of film itemised are illustrative rather than exclusive and suitable film patterns are also shown in British Pat. Nos. 914,489, 1,055,963, 1,075,487 and 1,110,051. However, as a practical point, it should be noted that whereas for ready net formation the "strand thickness" to "boss thickness" in the unstretched film is about 20%, for fibre production the strand showed preferably be somewhat thicker, e.g. be about 30% or more of the boss thickness.

Films to be subject to the process of the invention may be made be profiling an extruded melt (e.g. by flame perforation, embossing with suitable profiled chill rollers, embossing with pins or the like) or by profiling a film itself (e.g. by flame perforation again, or by post-embossing).

The film may have transverse grooves on one or both sides. In this form of the invention it is preferred to stretch the film longitudinally. (*a*) in an initial stage to fibrillate the material in the base of the grooves and (*b*) in a subsequent stage whereat the fibrils formed draw the material from the ridges between the grooves until the sheet separates, at least in part, as interconnected banded fibres. It is to be noted that simultaneous longitudinal and lateral stretching is inapplicable to this form of the invention since the necessary restraint encouraging fibrillation in the bottom of the grooves is provided by the ridges themselves. This form of the invention particularly advantageously uses two temperature stages during the two phases of stretching.

This also implies to an important alternative form of the invention wherein the film has non-longitudinal grooves at an angle to the transverse direction, e.g. from 30° to 60° and preferably 45°. Such a film may be stretched longitudinally to initiate crack and fibril formation i the base of the grooves and to propagate said fibrils through the material of the ridges separating the grooves thereby to produce a low-denier banded fibre. Other forms of the invention envisage the provision of a herringbone pattern, or a pattern of generally longitudinal parallel wavy lines on the film prior to stretching.

It is also advantageous for one surface of the film to be provided with parallel longitudinal grooves to facilitate splitting into longitudinal fibres on stretching and thus to decrease the degree of interconnection between the fibres, or to eliminate such interconnection.

Usually the degree of stretching will lie between 500 and 2000% depending on the material and method of stretching, preferably 800 – 1500%.

The film thickness used is dependent on the fibre denier required and can lie between 1 and 20 thousandths of an inch-usually about 2 – 10 thousandths.

While it is not intended to limit the scope of the invention in its broad aspect, it will generally be found that the frequency of banding (average separation between band centres is from 16 to 600 thousandths of an inch (0.4 – 15 mm).

The methods of the invention can be utilised on composite sheets of two or more different materials (e.g. laminated sheets and/or sheets made from homogeneous and/or heterogeneous blends).

The invention will be further described with reference to the accompanying drawings, wherein:

FIGS. 1, 2 and 3*a*–3*c* show longitudinal sections through different types of fibres according to the invention;

FIGS. 4, 4*a* and 4*b* shows one method of production of an array of fibres each of the type shown in FIG. 1 by drawing a film about 1200%;

FIGS. 5*a* and 5*b* each show an expanded form of an intermediate stage of the product of stretching an embossed film to produce fibres as shown in FIGS. 1 and 2;

FIG. 6 shows a sheet from which the fibre of FIG. 3*a* can be produced; and

FIG. 7 shows a modified form of sheet including heterogenerous blends which can be used in any of the methods of production but is especially useful for the method shown in FIG. 4.

Figure 1:
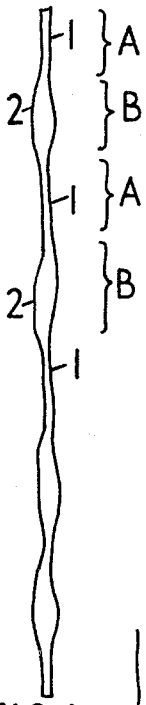
Figure 2:
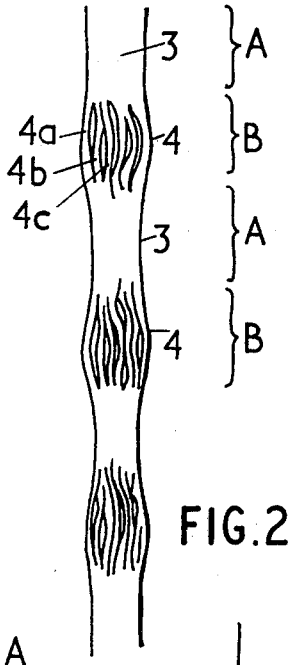

FIGS. 1 and 2, although diagrammatic are intended to be shown on the same scale. It will be seen that the fibres both have an irregular configuration. FIG. 1 shows a low-denier fibre having more or less regularly spaced thin portions 1 and thick portions 2, which here constitute the bands A and B respectively. These bands will in practice have different sizes of crystallites and orientations as well as different thicknesses. FIG. 2 shows a higher denier fibre having solid portions 3 (A) and multi-strand portions 4 (B) the individual strands of which are shown as 4*a*, 4*b* etc. It will be appreciated that these are idealised, diagrammatic representations since it is a consequence of the normal method of production of these fibres that there are numbers of extraneous fibrils always found in association with the fibres.

Figure 3A:
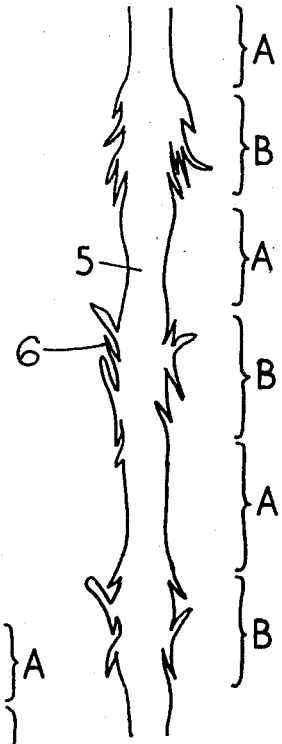

FIG. 3*a* shows a fibre 5 which is banded by consequence of identifiably different amounts of surface fibrillation 6 along its length.

Figure 3B:
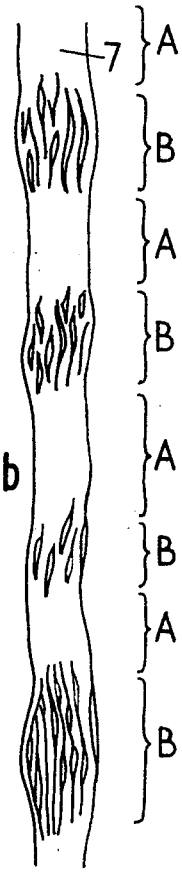

FIG. 3*b* shows a fibre 7 of the same type as the fibre of FIG. 2 but with much more irregularity in banding.

Figure 3C:
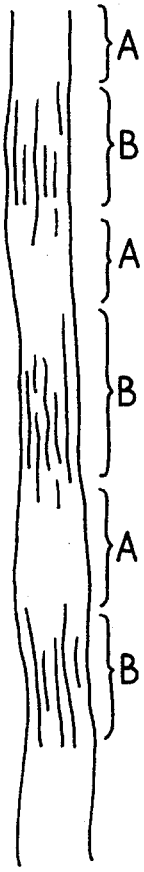

FIG. 3*c* shows a fibre of the type of FIG. 2 but wherein the multistrand nature of bands B is latent rather than apparent, i.e. wherein some internal splitting has occurred.

Figure 4:
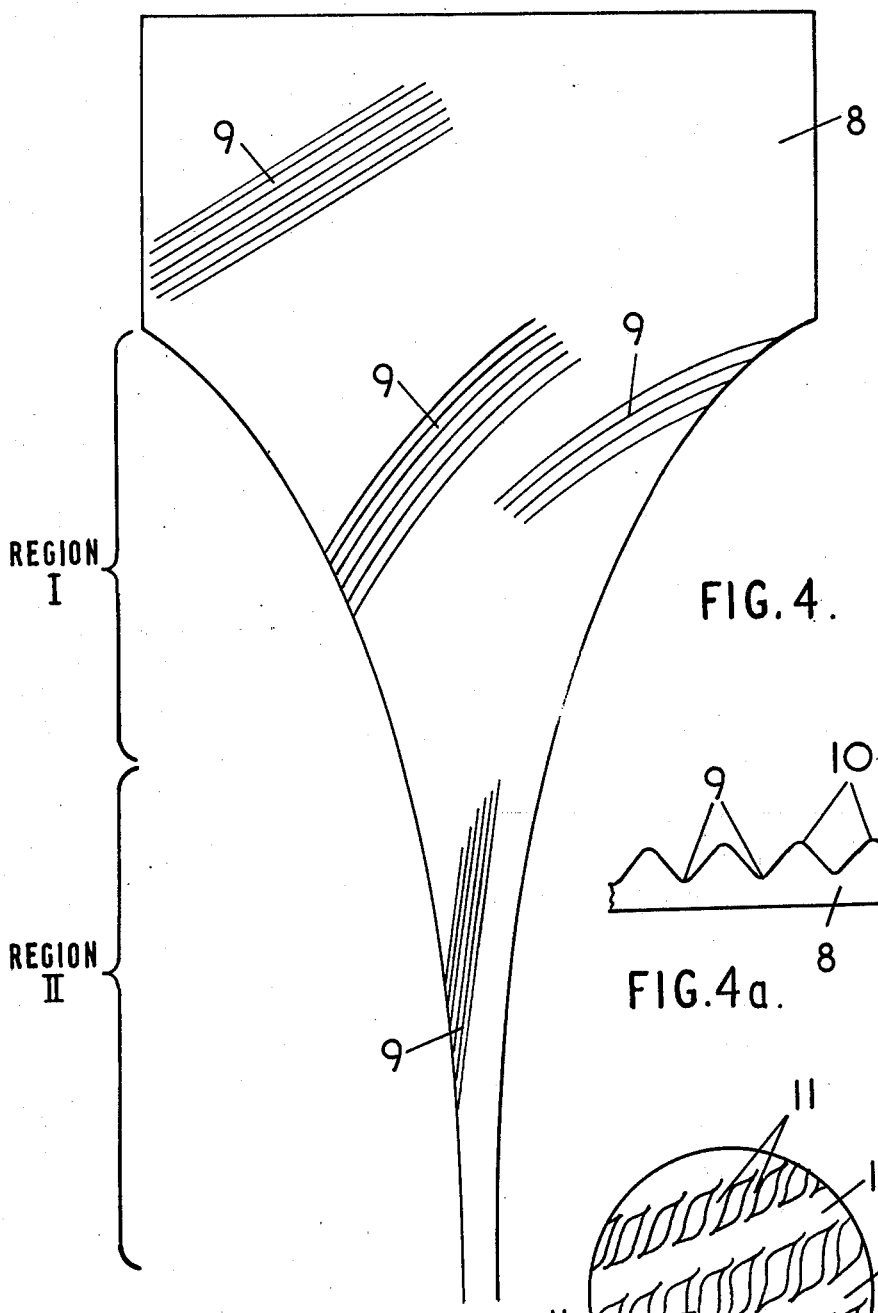
Figure 4A:
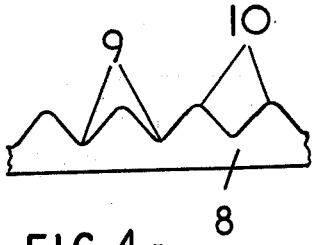

FIG. 4 shows how the fibre of FIG. 1 may be produced. A film of drawable synthetic plastic material 8 has grooves 9 extending across it, usually at an angle of between 30° and 60° to the edge. The grooves can best be produced by passing the hot melt over a roller with a succession of grooves of (in this particular example) triangular cross-section; that is to say the ridges 10 in the sheet are virtually triangular in cross-section although they may be rounded at the apex as shown in section in FIG. 4*a*. (In a modification, not shown, grooves may be provided at both sides and may be in or out of phase with one another).

Figure 4B:
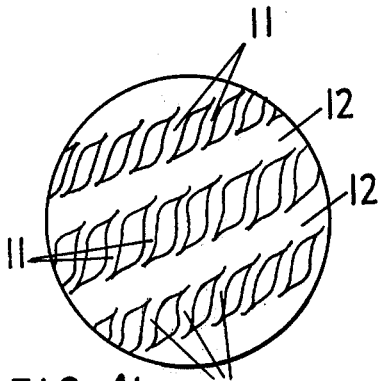

As the sheet is stretched, the grooves take up the configuration shown in Region I. The thick portions of the sheet prevent the thin portions (i.e. the bottoms of the grooves) from necking to relieve the stress and fibrillation takes place as shown under magnification in FIG. 4*b*.

As the sheet is stretched further (Region II), contrary to what might be expected, the fibrils II do not snap but peel away the thick portions 12 until each fibril penetrates the thick portion and connects to the fibril on the other side. It appears possible that the alignment of the original grooves so as to be almost parallel to the sheet edges is a cause of this. In other words, instead of obtaining rough high-denier fibres corresponding to the original sheet ridges we obtain a multitude of low-denier fibres as in FIG. 1 parallel to the sheet edges where the thin portion corresponds to a groove 9, the thick portion to a ridge 10 and the number of fibres to the number of fibrils formed during the initial stage of stretching.

It is important to note that the size the fibres is not predominantly dependent on sheet configuration but on the nature of the initial fibrillation in Region I.

The process may be carried out by a succession of rollers and the fully stretched sheet, substantially split into fibres can be formed into a fibrous bundle by further mechanical work.

By way of non-limiting example, a polypropylene sheet 16 inches (40 cms) wide and 0.01 inches (0.25 mm) thick was extruded at 250°C, fed into the nip comprising a cooling roller at 50° and a grooved roller also at 50°C having 35 grooves per inch each groove with intervening ridge being triangular in cross-section with a 90° included angle. The grooves extended across the face of the roller in such a way as to produce a sheet with straight parallel grooves and ridges extending at 60° to the sides of the film.

The sheet was stretched without lateral constraint by 300% at 60°C, followed by 300% (of the previously stretched length) at 145°C thereby giving an effective total stretch of 1500%. The resulting sheet was four inches (10 cms) wide and 0.0025 inches (0.0625 mm) thick. It was then slit into half-inch (1.25 cms) tapes each of which were twisted and wound up as a yarn. The yarn produced was soft and had good bulk, and consisted of individual banded fibres.

FIGS. 5*a* and 5*b* show how arrays of fibre broadly corresponding to those shown in FIG. 2 and also in some instances to those shown in FIG. 1 may be produced.

For convenience, a detailed description will first be limited to the stretching into fibres of a film having a regular pattern upon it of raised embossments, these embossments being part-spherical and arranged in a rhomboidal packing pattern with their peripheries closely adjacent.

If such a film is stretched in one direction without lateral restraint or lateral stretching, the rhomboidal pattern stretches uniaxially and can be considered as an elongated rhomboidal packing. Also, a longitudinal split forms halfway between laterally adjacent bosses and (although there is no need to open out the film at this stage) for demonstration purposes it can be pulled apart with virtually no transverse stress to show a clean netted structure as in FIG. 5*a*.

If, instead of being pulled apart transversely for demonstration purposes the film is then stretched according to the invention especially at elevated temperature the split between adjacent lateral bosses will tend to propagate and split the bosses in the preceding and subsequent rows. There is thus a tendency to fibre formation, each fibre being composed of alternate regions or bands corresponding respectively to the thinner strand portion between bosses and to the split and drawn boss, which yields a relatively longer thicker portion. Since it will prove difficult to separate individual fibres completely from each other, the final product will be a bundle of at least partially interconnected fibres each having the structure referred to.

If on the other hand the film is stretched simultaneously in two directions, or stretched with lateral restraint, splits begin to form one at either side of each boss. Also, the shear on the strands directly between each boss cause these strands themselves to fibrillate. The result is shown in FIG. 5*b* although again it is stressed that this is a purposely expanded film sharing in an opened form a structure which in the practice of the invention is normally latent but unapparent in a film stretched simultaneously in two directions just enough to promote the initial splitting and fibrillation but without being opened out.

Further stretching of such a film, generally speaking, especially at elevated temperature produces a more fibrillated fibre than further stretching of the film as shown in FIG. 5*a*. Although clearly various splits can be propagated, the predominant tendency will be to split through the drawn bosses, as before, and to produce a structure having relatively smooth bands corresponding to split and drawn bosses and relatively multistrand bands corresponding to the drawn fibrillated strands between the bosses.

Films to be subject to the process of the invention may be made by profiling extruded melt (e.g. by flame perforation, embossing with suitable profiled chill rollers, embossing with pins or the like) or by profiling a film itself (e.g. by flame perforation again, or by post-embossing).

While normally the fibres will be produced by stretching an embossed film without passing through an opened net stage it is possible also to produce them by stretching a previously formed net.

In summary, therefore, longitudinal stretching should produce a bundle of relatively smooth banded fibres while simultaneously longitudinal and lateral stretching in an early stage should lead on further stretching to an array of fibres which are individually split and fibrillated in bands along their length. This statement is generally true for fibres produced from embossed film, although the larger the bosses the more tendency there is for shear and therefore fibrillation to occur in the strands connecting them even when only uniaxial stretching and its consequent boss displacement takes place. Also, larger and differently shaped and arranged bosses may split in other fashions than a single split through the middle.

If the patterning on the film is other than raised embossments the general statement that simultaneous longitudinal and lateral initial stretch produces more fibrillation than that produced by longitudinal stretch is still generally true. However, in general, less fibrillation will be expected.

For example, stretching a film with a pattern of depressions upon its leads to less fibrillation than that obtained with embossments since the underpressed portions of the film are all of the same thickness.

Stretching a perforated film, while capable of producing a banded fibre, leads to little fibrillation since again all the remaining areas of the film are of the same thickness.

Another important consideration is that a flat strand fibrillates more readily than a round strand. Thus a pattern of recesses or perforations which are relatively close together whereby the material remaining in the basic film is in its strand portions of a non-flattened nature (i.e. is rounded, or at least has a width approximating to film thickness) will not readily fibrillate. The man skilled in the technique of stretching and fibrillating cold-drawable film will choose the pattern on the film so as to produce the desired banded effect. The fibres produced are at least partially interconnected, depending on the initial film pattern and the degree and nature of stretching. The extent of fibre interconnection can be reduced by having upon the film a pattern of longitudinal grooves, usually on the other surface from the pattern leading to fibre banding, in order to facilitate splitting up such grooves. Once again, the man skilled in the art will be able to match a desired size of longitudinal groove pattern with a given size and arrangement of, for example, bosses on the film.

The material of the film will also exert an effect on the nature of the fibre in that, as is known in itself, different materials fibrillate to different extents. Moreover, if the film is composed of a blended material, fibrillation and splitting into fibre is often facilitated due to melt orientation during extrusion of the initial film.

A particular advantage of this is that the melt-orientation leads to lines of weakness in the bosses on stretching and thus facilitate splitting of these bosses.

By way of non-limiting example an extruded sheet 0.01 inches thick was embossed with indentations in an hexagonal pattern with 0.05 inches between indentations, by a two-stage method, the second stage at elevated temperature as described above.

On 1500% stretching, coarser fibres (about 50 – 200 denier) were produced, being alternately banded by solid, translucent, portions and opaque, multistrand, portions every 5 mm.

The bands had the following properties:

| | | | |
|---|---|---|---|
| Breaking load (g) | Translucent Band | Average | 630 |
| | | range | 610 – 680 |
| | Opaque Band | Average | 496 |
| | | range | 430 – 580 |
| Extension (%) | Translucent Band | Average | 64.0 |
| | | range | 59.0 – 73.0 |
| | Opaque Band | Average | 41.4 |
| | | range | 35.0 – 47.0 |
| Tenacity (g/denier) | | Average | 3.0 |
| Density g/ml | Translucent Band | | 0.9074 |
| | Opaque Band | | 0.9056 |

It is important that in this embodiment the configuration of the eventual fibre depends upon the configuration of the original depressions. Moreover, although the stretching can be effected over rollers as before, the inclusion of a spiked frame or roller or like additional mechanical fibrillation step to separate the relatively mixed-denier banded fibres will be found advantageous.

FIG. 6 shows a sheet containing wavy grooves 16, produced for example by a suitably embossed roller. The grooves can also be a herringbone pattern and/or extend on both sides of the sheet. Without the process being shown in detail it will be appreciated how as such a sheet is stretched more fibrillation occurs at a high shear portions 17 at a greater angle to the direction of stretch than in the low shear portions 18. In this embodiment once again, the fibres formed will essentially correspond to the configuration of the sheet i.e. to the ridges between grooves 16, in contradistinction to the method of FIG. 4.

FIG. 7 shows two laminated polymers e.g. polypropylene 19 and heterogeneous polyamide/polypropylene mixture 20. If this is used in the above methods the heterogeneous mixture 20 fibrillates even more markedly than the thicker polypropylene, giving a fibre with a voluminous or fluffy surface layer containing a multitude of very small fibrils, in addition to the fibrils produced by the methods outlined above.

The methods and products of the invention are not limited to those shown above. For example, the grooved configuration of FIG. 4 can be applied to a sheet which also contains ribs and grooves parallel to the edge (i.e. the angled grooves can be minor superimpositions on the parallel ribs). The consequence of stretching such a sheet would be to obtain an array consisting of a number (corresponding to the number of ribs) of bundles of very fine fibres each fibre of the configuration as produced by the method shown in FIG. 4.

Other configurations of superimposed grooves may also be used, and there is a continuous range of grooved patterns which will give some form of banded fibres according to the invention.

For example, a sheet having transverse grooves, i.e. grooves at a right angle to the direction of stretch will tend to give thick and thin bands in fibres of an array produced on stretching and fibrillation. The bands have different degrees of orientation and different properties, and these differences become accentuated if an initial drawing is effected at a lower temperature and a subsequent drawing at a higher temperature. Moreover, a method of producing fibres by stretching a sheet with deep longitudinal grooves is already known; it is possible to combine this with the use of shallower, transverse, grooves to produce a more controlled splitting into relatively smooth banded fibres. One specific example of this is the stretching of 0.01 inch thick polypropylene sheet with 100 longitudinal grooves per inch and a similar concentration of shallower transverse grooves impressed over the longitudinal ridges.

Also, instead of stretching a sheet with a uniform splitting pattern, (i.e. FIG. 5) a hot sheet can be sprayed with water droplets to form a random pattern of different crystallinity areas leading to an array of random alternated fibres such as shown in FIG. 3b when stretched.

Furthermore it is possible to stretch a sheet of foamed material which has been differently compressed in a regular or random pattern. In this instance it should be noted that the thin areas are more resistant to splitting than the thicker areas.

We claim:

1. The method of making an array of substantially longitudinally disposed fibers in which individual fibers are within their length alternately fibrillated and banded and between which there are occasional connecting fibrils comprising starting with a drawable thermoplastic sheet which embodies areas of different degrees of fibrillation, cold drawing the sheet at a predetermined temperature to initiate the formation of embryonic longitudinally extending cracks in the areas of lower resistance to fibrillation, such that cracks terminate at the areas of higher resistance to fibrillation and further cold drawing the sheet but at a higher temperature to open said cracks and to cause propagation of the cracks through the areas of higher resistance to fibrillation, said drawings being effected without lateral extension.

2. A process as claimed in claim 1 in which the stretched sheet constituting the array is formed into a bundle of separate fibres.

3. A process as claimed in claim 1 wherein the film has on at least one surface a regular pattern of discrete raised embossments.

4. A process as claimed in claim 3 in which the embossments are hexagonally packed on the surface.

5. A process as claimed in claim 4 wherein the film is first stretched longitudinally without lateral restraint to initiate a longitudinal crack between each laterally adjacent pair of embossments and further stretched to propagate the crack through elongated and orientated embossments in preceding and subsequent rows thereof so as to form a longitudinal array of interconnected banded fibres, the bands on which correspond to the strands connecting the embossments and to the split elongated embossments themselves respectively.

6. A process as claimed in claim 4 wherein the film is (a) stretched to initiate pairs of cracks one crack of each pair on each side of each embossment, and to fibrillate the strands formed between each embossment and (b) further stretched longitudinally without lateral stretching so that the embossments stretch and orientate and the cracks propagate and split the embossments so as to form a bundle of interconnected banded fibres the bands on which correspond to the fibrillated strands connecting the embossments, and to the split embossments themselves respectively.

7. A process as claimed in claim 1 wherein the film has on at least one surface a regular pattern of discrete depressions.

8. A process as claimed in claim 1 wherein the film has on at least one surface a regular pattern of two intersecting sets of parallel straight intersecting grooves.

9. A process as claimed in claim 1 wherein the film has on one surface a set of parallel grooves and on the other surface another set of parallel grooves the two sets lying in intersecting directions.

10. A process as claimed in claim 1 wherein the film has transverse grooves on one or both sides and is stretched longitudinally (a) in an initial stage at a lower temperature to fibrillate the material in the base of the grooves and (b) in a subsequent stage at a higher temperature whereat the fibrils formed draw the material from ridges between the grooves until the sheet separates, at least in part, as interconnected banded fibres.

11. A process as claimed in claim 1 wherein the film has non-longitudinal grooves at an angle to the transverse direction and the film is stretched longitudinally to initiate crack and fibril formation in the base of the grooves and to propagate said fibrils through the material of the ridges separating the grooves thereby to produce a low-denier banded fibre.

* * * * *